US010081895B2

(12) United States Patent
Koike et al.

(10) Patent No.: US 10,081,895 B2
(45) Date of Patent: Sep. 25, 2018

(54) HORIZONTAL ROTARY HOOK OF SEWING MACHINE

(71) Applicant: JANOME SEWING MACHINE Co., Ltd., Tokyo (JP)

(72) Inventors: Mikio Koike, Tokyo (JP); Yasuhiro Osanai, Tokyo (JP); Yasuhiko Komiya, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 571 days.

(21) Appl. No.: 14/522,468

(22) Filed: Oct. 23, 2014

(65) Prior Publication Data

US 2015/0308023 A1 Oct. 29, 2015

(30) Foreign Application Priority Data

Apr. 24, 2014 (JP) ..... 2014-090424

(51) Int. Cl.
*D05B 57/14* (2006.01)
*D05B 57/20* (2006.01)
*D05B 57/26* (2006.01)

(52) U.S. Cl.
CPC ..... *D05B 57/143* (2013.01); *D05B 57/20* (2013.01); *D05B 57/26* (2013.01)

(58) Field of Classification Search
CPC ..... D05B 57/00; D05B 57/02; D05B 57/04; D05B 57/14; D05B 57/143; D05B 57/20; D05B 57/26; D05B 57/265
See application file for complete search history.

(56) References Cited

U.S. PATENT DOCUMENTS 3,581,687 A * 6/1971 Meier ..... D05B 59/00 112/279
4,676,178 A * 6/1987 Hirose ..... D05B 57/143 112/231
5,076,182 A * 12/1991 Hirose ..... D05B 57/26 112/228
7,171,914 B2 * 2/2007 Ota ..... D05B 57/20 112/231
8,342,110 B2 * 1/2013 Cerliani ..... D05B 69/32 112/231

FOREIGN PATENT DOCUMENTS

JP 2006-094905 A 4/2006

* cited by examiner

*Primary Examiner* — Nathan Durham
(74) *Attorney, Agent, or Firm* — McGinn I.P. Law Group, PLLC.

(57) ABSTRACT

Provided is a horizontal rotary hook including: an inner rotary hook including an attracted member made of metal in an outer lower surface portion; a permanent magnet that attracts the inner rotary hook; a magnet plate accommodating the permanent magnet and provided with a mounting hole at a center of a diameter thereof; a non-metallic outer rotary hook accommodating the magnet plate and having a shaft hole at a center of a diameter of an inner bottom portion thereof; and a hook supporting shaft that is inserted through the hole of the magnet plate and the shaft hole of the outer rotary hook and includes, at an upper end thereof, a flange for rotatably supporting the outer rotary hook and the magnet plate. A friction coefficient of a contact surface of the magnet plate that comes into contact with the outer rotary hook is set to be larger than a friction coefficient of the flange of the hook supporting shaft.

13 Claims, 5 Drawing Sheets

Fig. 1C ENLARGED SECTION α

HORIZONTAL ROTARY HOOK OF SEWING MACHINE

BACKGROUND OF THE INVENTION

1. Field of the Invention

The present invention relates to a horizontal rotary hook of a sewing machine that can have an extremely simple configuration and includes a configuration in which a permanent magnet for disposing, in an outer rotary hook, an inner rotary hook having a metal plate in a bottom portion is fixed to a bottom portion of the outer rotary hook.

2. Description of the Related Art

Generally, sewing machines include a horizontal rotary hook device accommodating a bobbin. The horizontal hook device includes outer and inner rotary hooks. A gear shaft is integrally attached to a lower end surface of the outer rotary hook. A gear is fixedly mounted to a lower shaft and meshes with the gear shaft. Thus, the outer rotary hook rotates along with the rotation of the lower shaft.

The inner rotary hook accommodated in the outer rotary hook might make random movement such as oscillation during a sewing operation. Such random movement of the inner rotary hook causes noise and affects sewing performance. Japanese Patent Application Laid-open No. 2006-94905 discloses a specific configuration for addressing this problem. Specifically, the configuration is one of various configurations in which a magnet is used to prevent the inner rotary hook accommodated in the outer rotary hook from floating during the sewing operation.

Japanese Patent Application Laid-open No. 2006-94905 can achieve a state where the inner rotary hook in the outer rotary hook is extremely stable, and thus can solve various problems attributable to the random movement of the inner rotary hook. The outer rotary hook may be made of a metal material as a magnetic material, so that the configuration where the inner rotary hook is magnetically attracted to be fixed is easily achieved. However, in recent years, the outer rotary hook has been made of a synthetic resin material as a non-magnetic material in many cases for the sake of cost and the like. Thus, the magnet is fixedly attached to the bottom surface of the outer rotary hook made of the synthetic resin with an adhesive, an adhesive tape, and the like.

When the adhesive or the adhesive tape is used for the fixing, contact surfaces of the inner rotary hook and the magnet need to be cleaned so that the magnet and the inner rotary hook favorably adhere to each other, the bottom surface of the outer rotary hook needs to be cleaned, and even a degreasing treatment is required to remove oil. The adhesiveness of the adhesive is low unless such treatments are sufficiently performed. Thus, the magnet is likely to be detached from the bottom surface of the outer rotary hook while the sewing machine is under operation. However, the cleaning of the bottom surface of the outer rotary hook and the removal of oil (degreasing treatment) require additional cumbersome operation steps which in turn complicate an assembling operation.

Thus, in the configuration of Japanese Patent Application Laid-open No. 2006-94905, a yoke member formed of a magnetic body is mounted to a bottom portion of the outer rotary hook, and a magnet piece is fixedly attached to the yoke member. The yoke member has a form of a plate, and includes a circular circumferential wall. The circumferential wall is not continuously formed in the circumferential direction. The circumferential wall is partially notched at an equal interval to form a plurality of protrusions that engage with ribs of the outer rotary hook. Thus, the yoke member can be fixed in a stable state, without rotating with the outer rotary hook (see FIG. 5A).

Unfortunately, in this configuration, a needle thread n of the bobbin is likely to be caught by the notches in the circumferential wall, defined by the protrusions of the yoke member or an engaging portion between the protrusions and the ribs (see FIG. 5B), to hamper the sewing operation of the sewing machine (see FIG. 5). Furthermore, to form the protrusions and the like on the yoke member, steps for manufacturing the yoke member are increased and even a unit price of the yoke member might be increased.

Furthermore, forming the notches in the circumferential wall of the yoke member further raises a problem in that strong magnetic force of a magnet piece disposed in the yoke member cannot be achieved. A technical goal (object) achieved by the present invention is to fix a fixing holder, for fixing the permanent magnet, stably to the outer rotary hook and prevent a thread extending from the bobbin from being caught in the hook, with an extremely simple configuration that does not use a plurality of protrusions as an anti-rotation unit.

SUMMARY OF THE INVENTION

The inventors made vigorous studies to achieve the goal. The goal is achieved by a first aspect of the present invention that is a horizontal rotary hook for a sewing machine, including: an inner rotary hook including an attracted member made of metal in an outer lower surface portion; a permanent magnet that attracts the inner rotary hook; a magnet plate accommodating the permanent magnet and provided with a mounting hole at a center of a diameter thereof; a non-metallic outer rotary hook accommodating the magnet plate and having a shaft hole at a center of a diameter of an inner bottom portion thereof; and a hook supporting shaft that is inserted through the hole of the magnet plate and the shaft hole of the outer rotary hook and includes, at an upper end thereof, a flange for rotatably supporting the outer rotary hook and the magnet plate. A friction coefficient of a contact surface of the magnet plate that comes into contact with the outer rotary hook is set to be larger than a friction coefficient of the flange of the hook supporting shaft to provide a difference in a frictional resistance.

As a second aspect of the present invention to achieve the goal, a low friction member for reducing a frictional resistance is provided between the flange of the hook supporting shaft and the magnet plate, so that the friction coefficient of the contact surface of the magnet plate that comes into contact with the outer rotary hook is set to be larger than the friction coefficient of the flange of the hook supporting shaft to provide the difference in the frictional resistance, in the horizontal rotary hook for the sewing machine as the first aspect of the present invention.

As a third aspect of the present invention to achieve the goal, the flange is subjected to surface finishing for reducing a frictional resistance between the flange of the hook supporting shaft and the magnet plate, so that the friction coefficient of the contact surface of the magnet plate that comes into contact with the outer rotary hook is set to be larger than the friction coefficient of the flange of the hook supporting shaft to provide the difference in the frictional resistance, in the horizontal rotary hook for the sewing machine as the first aspect of the present invention.

As a fourth aspect of the present invention to achieve the goal, the contact surface of the magnet plate to be in contact with the flange is subjected to surface finishing for reducing a frictional resistance between the flange of the hook supporting shaft and the magnet plate, so that the friction coefficient of the contact surface of the magnet plate that comes into contact with the outer rotary hook is set to be larger than the friction coefficient of the flange of the hook supporting shaft to provide the difference in the frictional resistance, in the horizontal rotary hook for the sewing machine as the first aspect of the present invention.

In the present invention, the difference in the frictional resistance is provided. Specifically, a frictional resistance between a lower end surface (a bottom surface of an accommodating recess) in the bottom portion of the outer rotary hook and the magnet plate is set to be larger than a frictional resistance between the flange of the hook supporting shaft and the magnet plate. Thus, the magnet plate rotates together with the outer rotary hook.

Thus, the magnet plate can have a simple circular shape, and can be fixed in the circumferential direction in the bottom portion (or the accommodating recess formed in the bottom portion) of the outer rotary hook without having a member to be engaged and fixed to the bottom portion of the outer rotary hook. The magnet plate can rotate together with the outer rotary hook, and thus the permanent magnet can also rotate together with the outer rotary hook.

Thus, the magnet plate and the permanent magnet are fixed while being extremely stable with respect to the outer rotary hook, and thus can be prevented from rattling while the outer rotary hook is rotating. Accordingly, with the permanent magnet mounted to the outer rotary hook in the stable state, the inner rotary hook is also mounted to the outer rotary hook in an extremely stable state, to be prevented from rattling.

The magnet plate and the bottom portion of the outer rotary hook are provided with no protrusions, notches, recesses, or the like that make the magnet plate and the bottom portion engage with each other for fitting and fixing. Thus, a needle thread of a bobbin disposed in the inner rotary hook can be prevented from being caught in the outer rotary hook during a sewing operation of the sewing machine to hamper the sewing operation.

BRIEF DESCRIPTION OF THE DRAWINGS

FIG. 1C is an enlarged view of a section α in FIG. 1A;

DESCRIPTION OF THE PREFERRED EMBODIMENTS

Figure 1A:
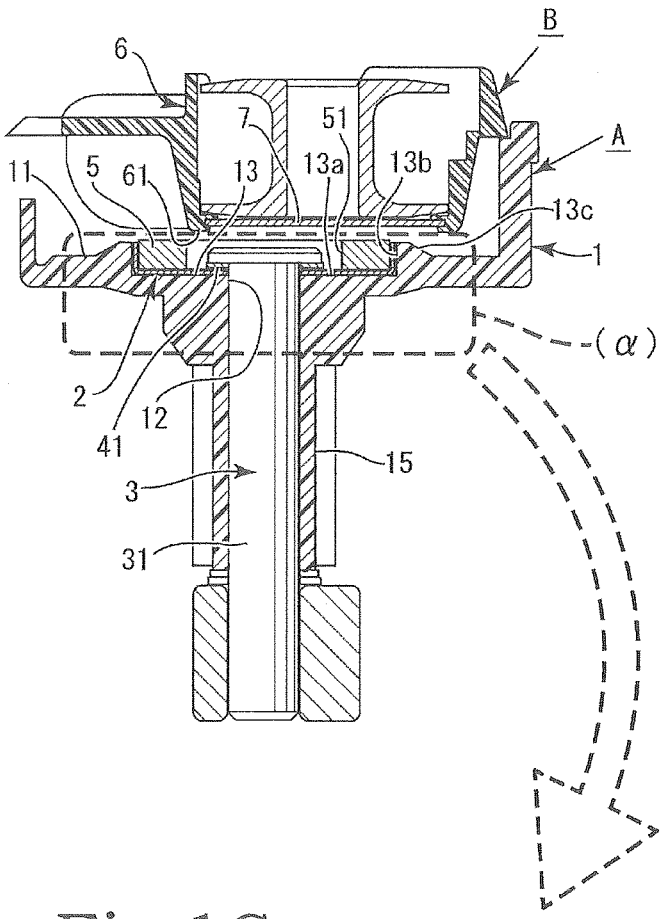
FIG. 1A is a vertical cross-sectional view including a magnet plate of a first embodiment of the present invention.
Figure 1B:
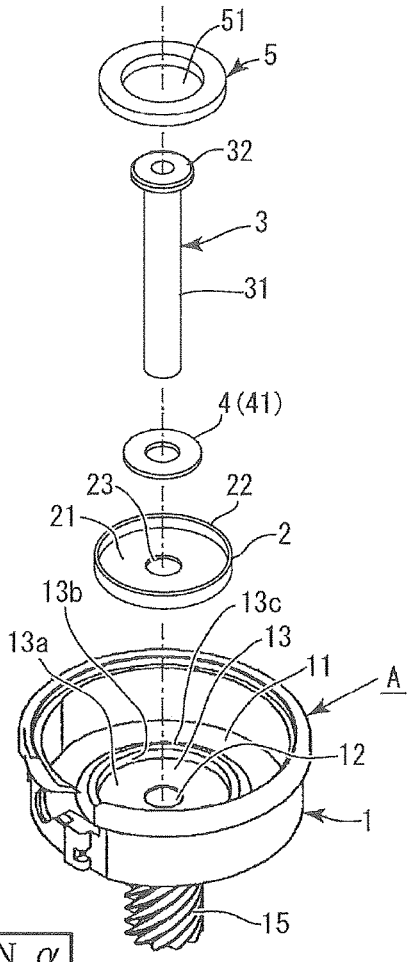
FIG. 1B is a perspective view of a horizontal rotary hook of the present invention in an unassembled state.
Figure 1B:
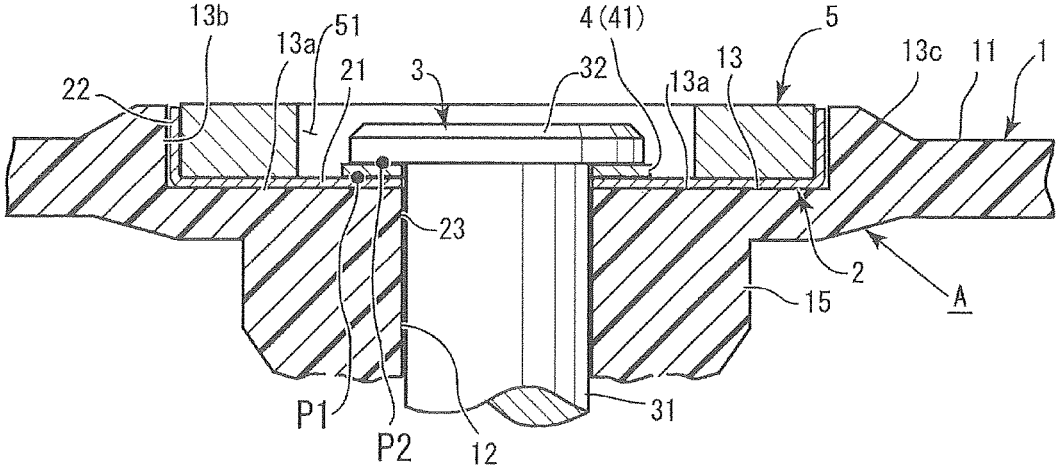
Figure 2A:
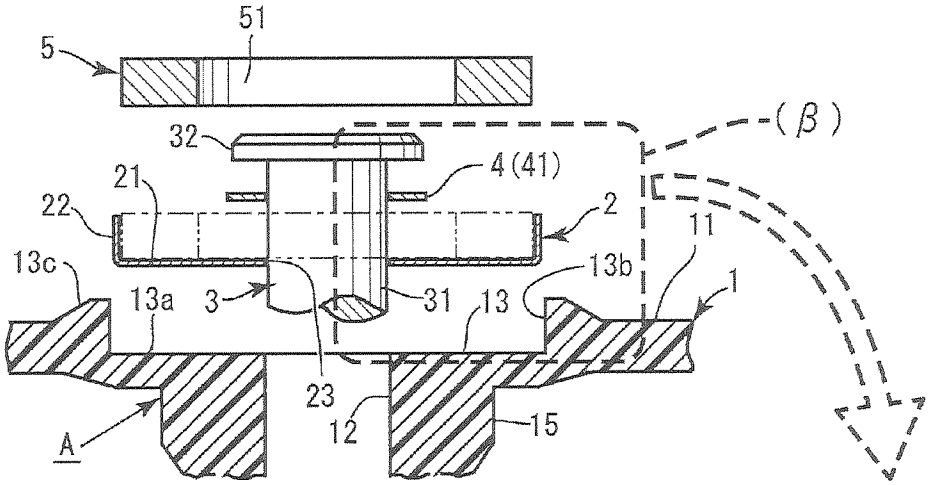
FIG. 2A is an enlarged vertical cross-sectional view of a main portion in a state where an outer rotary hook, a magnet plate, a hook supporting shaft, and a permanent magnet are unassembled in the present invention.
Figure 2B:
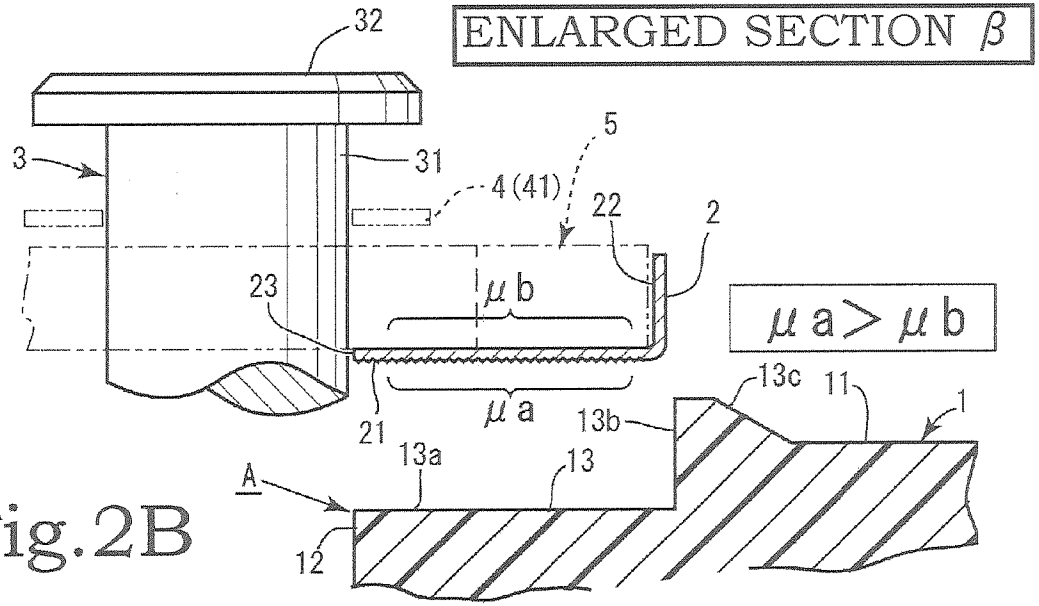
FIG. 2B is an enlarged view of a section β in FIG. 2A.
Figure 3:
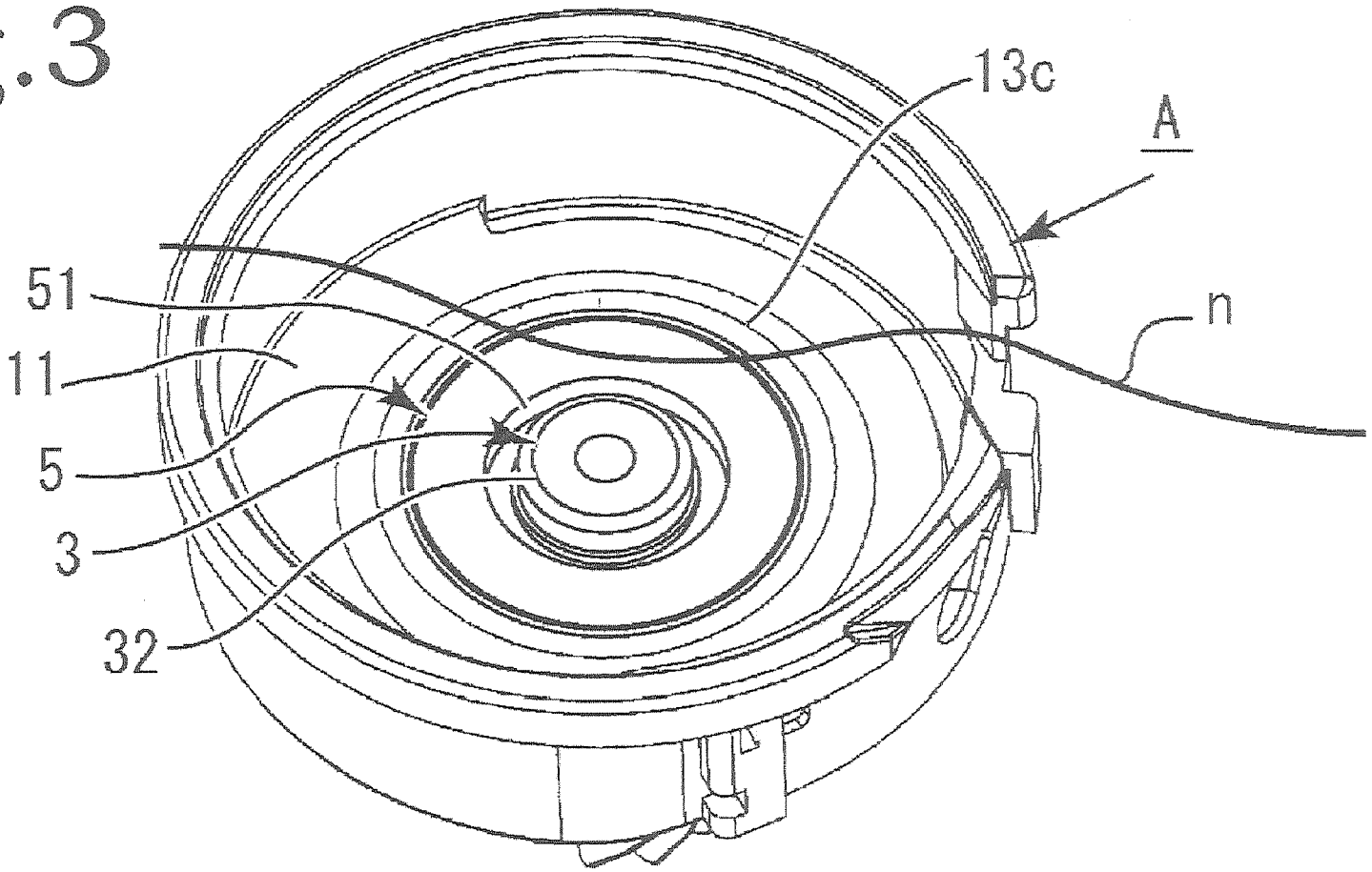
FIG. 3 is a perspective view of a state where a needle thread is not caught by a bottom portion of the outer rotary hook in the present invention.

An embodiment of the present invention will be described below based on the drawings. As shown in FIGS. 1, 2, and 3, a horizontal rotary hook of the present invention mainly includes an outer rotary hook A, a magnet plate 2, a hook supporting shaft 3, a permanent magnet 5, and an inner rotary hook B. The outer rotary hook A mainly includes an outer rotary hook main body 1, a gear shaft 15, and the like (see FIG. 1).

The gear shaft 15 is integrally attached to the outer rotary hook main body 1. A driving gear (not shown) that meshes with the gear shaft 15 rotates the outer rotary hook A. The outer rotary hook main body 1 has a form of a flat cylindrical cup and is made of a synthetic resin such as plastic. An opening is formed in an upper portion of the outer rotary hook main body 1. A bottom portion 11 is formed in a lower portion of the outer rotary hook main body 1. The bottom portion 11 has a substantially circular shape (see FIG. 1B).

An accommodating recess 13 is formed in the bottom portion 11 (see FIG. 1). The accommodating recess 13 is a portion forming the bottom portion 11 and is a part of the bottom portion 11. The accommodating recess 13 is a flat and circular space. The center of the diameter of the accommodating recess 13 is at a center portion of the bottom portion 11. The magnet plate 2 and the permanent magnet 5 are accommodated in the accommodating recess 13. The accommodating recess 13 has a shape of a flat and cylindrical recess with an inner circumferential wall 13*b*. The shape of the inner circumferential wall 13*b* is substantially the same as the outer circumferential shapes of the magnet plate 2 and the permanent magnet 5. The accommodating recess 13 has a flat bottom surface 13*a*.

Figure 4A:
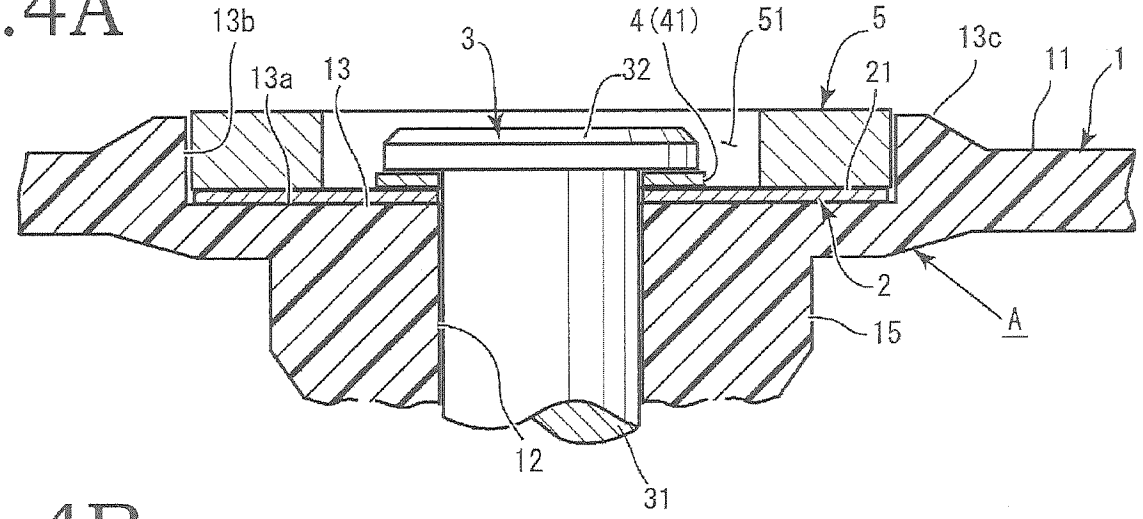
FIG. 4A is an enlarged vertical cross sectional view of a main portion including a magnet plate of a second embodiment of the present invention.
Figure 4B:
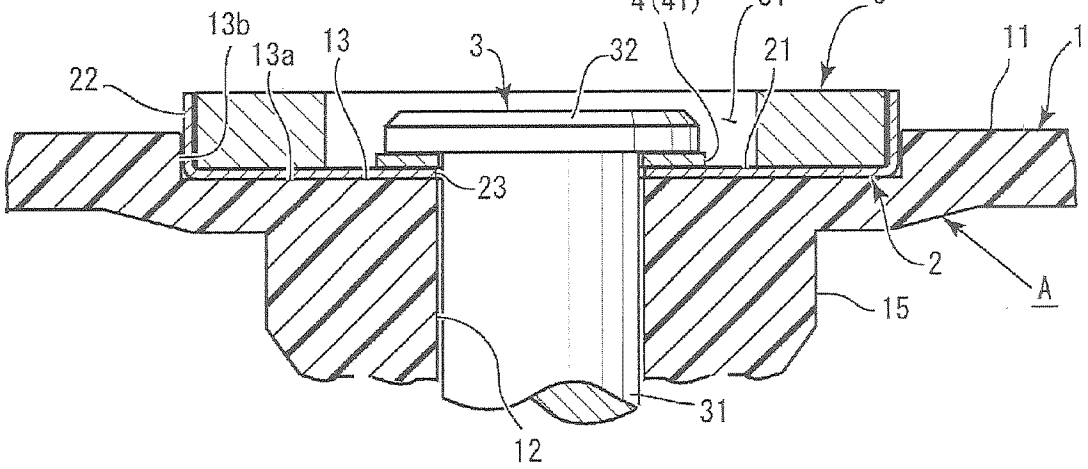
FIG. 4B is an enlarged vertical cross sectional view of a main portion in an embodiment where the magnet plate is placed in the accommodating recess without a protrusion.
Figures 5A, 5B:
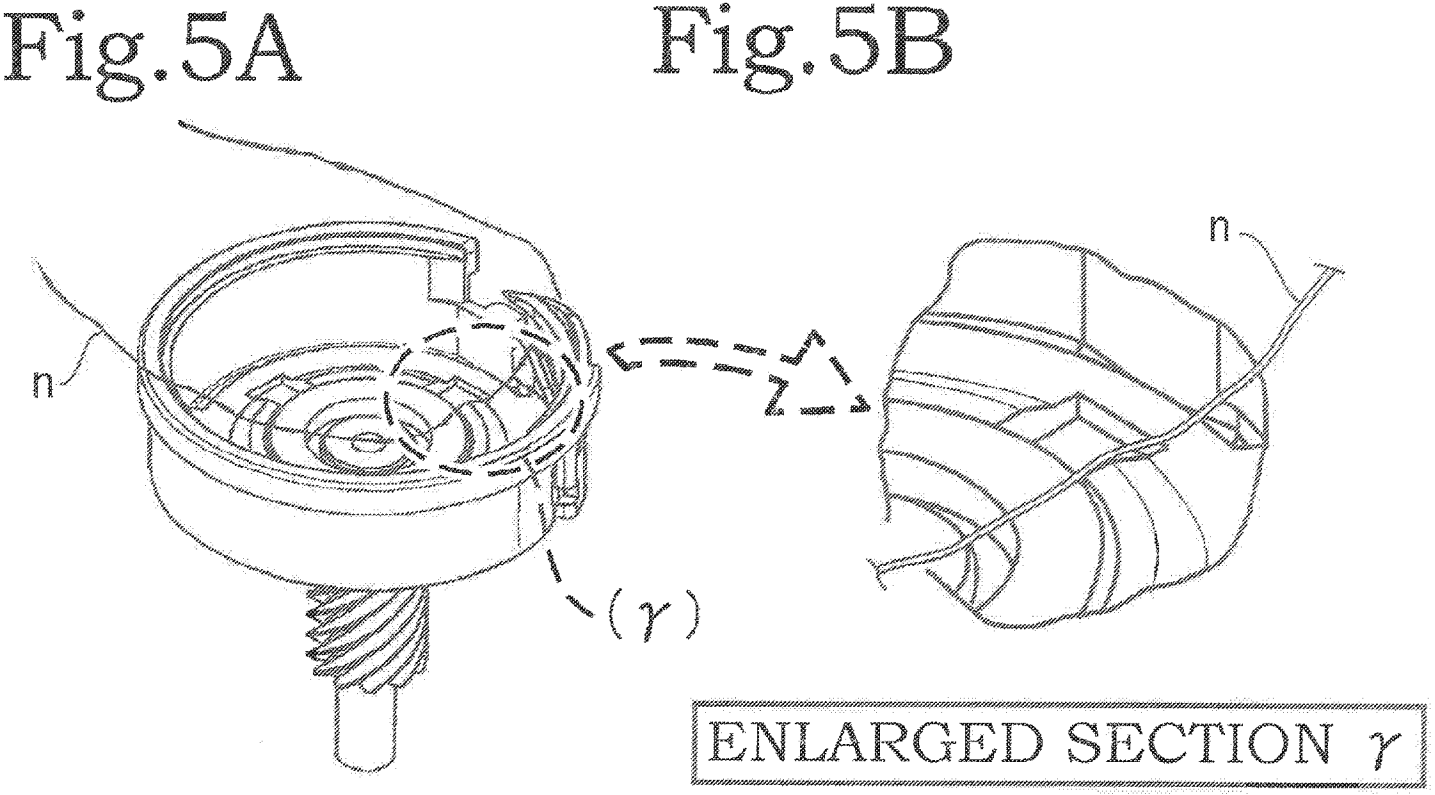
Fig.5B RELATED ART
FIG. 5A is a perspective view of a state where the needle thread is caught by the bottom portion in a conventional technique.
FIG. 5B is an enlarged perspective view of a section γ in FIG. 5A.

The accommodating recess 13 is provided with the circular continuous inner circumferential wall 13*b*. A protrusion 13*c*, protruding upward from the bottom portion 11, is formed along the inner circumferential wall 13*b* (see FIGS. 1 and 2). The protrusion 13*c* is a raised portion having an annular shape and is continuously formed in a circumferential direction. The protrusion 13*c* has a flat conical outer circumferential shape. There is also an embodiment where the accommodating recess 13 has no protrusion 13*c* and only has the bottom surface 13*a* and the inner circumferential wall 13*b* (see FIG. 4B).

A shaft hole 12 is formed at the center of the bottom portion 11. The position where the shaft hole 12 is formed also corresponds to the center of the diameter of the accommodating recess 13. The hook supporting shaft 3 described later penetrates through the shaft hole 12. The gear shaft 15 is formed on a lower surface side of the bottom portion 11. The gear shaft 15 is a member in a form of a shaft. An outer circumference of the gear shaft 15 is threaded to be in a form of a gear. The gear shaft 15 is orthogonal to the bottom portion 11.

The shaft hole 12 is formed along the axial core of the gear shaft 15. Thus, the gear shaft 15 has a form of a hollow tube. The height of the inner circumferential wall 13*b* of the accommodating recess 13 from the bottom surface 13*a* includes a height to the top portion of the protrusion 13*c*. There is also an embodiment where the protrusion 13*c* is not formed, and thus the accommodating recess 13 is simply formed as a flat circular cylindrical recess in the bottom portion 11 (see FIG. 4B).

The magnet plate 2, in various embodiments, has a form of a tray (flat cylindrical cup). A raised portion 22 is formed along the outer circumference of a main plate portion 21 as the bottom of the magnet plate 2 (see FIG. 1, FIG. 2A, FIG. 4B, and the like).

The outer diameter of the magnet plate 2 is slightly smaller than the inner diameter of the accommodating recess 13. Thus, a size relationship is achieved where a small gap is formed between the outer circumference of the magnet plate 2 and the inner circumference of the accommodating recess 13. A shaft hole 23 is formed at the center of the diameter of the main plate portion 21 of the magnet plate 2. In a state where the magnet plate 2 is inserted in the accommodating recess 13, the position of the shaft hole 23 of the magnet plate 2 matches the shaft hole 12 of the outer rotary hook A. As a second embodiment of the magnet plate 2, the magnet plate 2 is formed of the main plate portion 21 only (see FIG. 4A).

The hook supporting shaft 3 includes a supporting shaft 31 and a flange 32 formed at an end of the supporting shaft 31. The flange 32 has a form of a disk having a diameter larger than that of the supporting shaft 31. The supporting shaft 31 of the hook supporting shaft 3 is inserted through the shaft hole 23 of the magnet plate 2 and the shaft hole 12 of the outer rotary hook A. The flange 32 comes into contact with a periphery of the shaft hole 23 of the main plate portion 21 of the magnet plate 2. A contact surface of the flange 32 that comes into contact with the periphery of the shaft hole 23 may be subjected to surface finishing (processed) to reduce a frictional resistance.

Thus, the contact surface of the magnet plate 2 that comes into contact with the outer rotary hook A has a friction coefficient larger than that of the flange 32 of the hook supporting shaft 3. Thus, with a difference in a frictional resistance between a contact portion between the magnet plate 2 and the outer rotary hook A, and a contact portion between the magnet plate 2 and the flange 32, the magnet plate 2 rotates along with the rotation of the outer rotary hook A.

A low friction member 4 for reducing the frictional resistance may be disposed between the flange 32 and the main plate portion 21 of the magnet plate 2. Specifically, the low friction member 4 is a washer 41 subjected to surface finishing (processed) on both surfaces to reduce the frictional resistance. Alternatively, the washer 41 made of resin with a low friction coefficient such as fluororesin or polyacetal or a sheet made of the resin may be used.

The permanent magnet 5 has a form of a flat annular plate, and is attracted to the magnet plate 2 to be disposed in the accommodating recess 13 of the outer rotary hook A. The permanent magnet 5 is formed of a metal material such as an iron material or a rubber material. A through hole 51 is formed at the center of the permanent magnet 5. The inner diameter of the through hole 51 is larger than the outer diameter of the flange 32 of the hook supporting shaft 3. Thus, the flange 32 fits within the through hole 51. The outer diameter of the outer periphery of the permanent magnet 5 is set in such a manner that the permanent magnet 5 fits within the raised portion 22 of the magnet plate 2.

The inner rotary hook B includes a container main body 6 in a form of a container and an attracted member 7. A bobbin chamber is provided in the inner rotary hook B. A lower surface, that is, a bottom surface portion 61 of the container main body 6 of the inner rotary hook B is provided with the attracted member 7 formed of a magnetic material. The container main body 6 is made of a synthetic resin such as plastic. Specifically, the attracted member 7 is formed of a metallic thin plate. The attracted member 7 is disposed to be exposed on the lower surface side of the inner rotary hook B.

The attracted member 7 is positioned on a lower surface side of the inner rotary hook B, that is, a lower surface side (that is, a lower surface of the inner rotary hook B) of the bottom surface portion 61 of the container main body 6. Specifically, the attracted member 7 may be formed to provide substantially the same effect as the bottom surface portion 61 of the inner rotary hook B.

In this case, a substantially circular through hole is formed in a center portion of the bottom surface portion 61, and the attracted member 7 is mounted to close the through hole. The attracted member 7 is mounted by resin casting on the container main body 6. The bottom surface portion 61 may cover the entire bottom portion of the container main body 6, and the attracted member 7 may be formed to be embedded to have one surface exposed on the lower surface side of the bottom surface portion 61.

How the horizontal rotary hook is assembled in the present invention will be described. As described above, the outer rotary hook A has the accommodating recess 13 formed in the bottom portion 11. The magnet plate 2 is disposed in the accommodating recess 13. A gap is provided between the accommodating recess 13 and the outer circumference of the magnet plate 2 or, when the raised portion 22 is formed, the raised portion 22. Thus, the magnet plate 2 can be easily inserted into the accommodating recess 13 to be disposed.

In a state where the magnet plate 2 is accommodated in the accommodating recess 13, the supporting shaft 31 of the hook supporting shaft 3 is inserted through the shaft hole 23 of the magnet plate 2 and the shaft hole 12 of the outer rotary hook A, whereby the hook supporting shaft 3 is fixed at a predetermined position in a sewing machine main body. The outer rotary hook A can freely rotate about the hook supporting shaft 3. A frictional resistance P1 between the bottom surface 13*a* of the accommodating recess 13 formed in the bottom portion 11 of the outer rotary hook A and the magnet plate 2 is set to be larger than a frictional resistance P2 between the flange 32 of the hook supporting shaft 3 and the magnet plate 2, that is P1>P2.

Thus, a configuration where the magnet plate 2 is likely to be dragged by the rotation of the outer rotary hook A is achieved. As a result, when the outer rotary hook A rotates, the magnet plate 2 rotates together with the bottom portion 11. Furthermore, slipping occurs between the flange 32 and the magnet plate 2. All things considered, the magnet plate 2 rotates along with the rotation of the outer rotary hook A, whereby the permanent magnet 5 attracted to the magnet plate 2 can also rotate at the rotating speed that is substantially the same as that of the outer rotary hook A.

The following configuration is provided to set the frictional resistance P2 between the flange 32 of the hook supporting shaft 3 and the magnet plate 2 to be smaller than the frictional resistance P1 between the bottom surface 13*a* of the accommodating recess 13 formed in the bottom portion 11 of the outer rotary hook A and the magnet plate 2 as described above.

A friction coefficient $\mu 1$ on a lower surface side of the main plate portion 21 of the magnet plate 2 is set to be larger than a friction coefficient $\mu 2$ on an upper surface side, that is, $\mu 1 > \mu 2$.

Specifically, the main plate portion 21 is provided with a coarse surface on the lower surface side and a smooth surface on the upper surface side. Alternatively, the main plate portion 21 of the magnet plate 2 has flat upper and lower surfaces, and the accommodating recess 13 has a coarse bottom surface 13*a* and the flange 32 has a smooth lower surface.

Thus, as described above, the difference in the frictional resistance is provided so that the frictional resistance P1 between the bottom surface 13*a* of the accommodating recess 13 formed in the bottom portion 11 of the outer rotary hook A and the magnet plate 2 is set to be larger than the frictional resistance P2 between the flange 32 of the hook supporting shaft 3 and the magnet plate 2. Thus, the magnet plate 2 rotates along with the rotation of the outer rotary hook A.

The washer 41 made of a synthetic resin, as the low friction member 4, may be disposed between the flange 32 of the hook supporting shaft 3 and the main plate portion 21 of the magnet plate 2. Thus, the frictional resistance P2 between the flange 32 and the magnet plate 2 is set to be smaller than the frictional resistance P1 between the bottom surface 13*a* of the accommodating recess 13 and the magnet plate 2, through the washer 41.

As described above, the magnet plate 2, having a simple circular shape without a member for engaging with the accommodating recess 13 to be fixed, can be inserted to be disposed in the accommodating recess 13 to be fixed in the circumferential direction. Thus, the magnet plate 2 can rotate along with the rotation of the outer rotary hook A, whereby the permanent magnet 5 can also rotate along with the rotation of the outer rotary hook A.

The magnet plate 2 and the permanent magnet 5 can be fixed while being extremely stable with respect to the outer rotary hook A. Thus, the magnet plate 2 and the permanent magnet 5 can be prevented from rattling while the outer rotary hook A is rotating. Accordingly, with the permanent magnet 5 stably mounted to the outer rotary hook A, the inner rotary hook B can be mounted to the outer rotary hook A in an extremely stable state without rattling.

As described above, the magnet plate 2 and the accommodating recess 13 are provided with no protrusions, notches, recesses, or the like that make the magnet plate 2 and the accommodating recess 13 engage with each other for fitting and fixing. Thus, a needle thread n of a bobbin disposed in the inner rotary hook B can be prevented from being caught in the outer rotary hook A during a sewing operation of the sewing machine to hamper the sewing operation.

In second, third, and fourth embodiments, with extremely simple configurations, the difference in the frictional resistance can be provided so that the magnet plate can rotate along with the rotation of the outer rotary hook, and the permanent magnet can also rotate along with the rotation of the outer rotary hook.

What is claimed is:

1. A horizontal rotary hook for a sewing machine, the horizontal rotary hook comprising:

an inner rotary hook including an attracted member comprising a metal in an outer lower surface portion;

a permanent magnet that attracts the inner rotary hook;

a magnet plate accommodating the permanent magnet and provided with a mounting hole at a center of a diameter thereof;

a non-magnetic outer rotary hook accommodating the magnet plate and including a shaft hole at a center of a diameter of an inner bottom portion thereof; and a hook supporting shaft that is inserted through the mounting hole of the magnet plate and the shaft hole of the outer rotary hook and includes, at an upper end thereof, a flange for rotatably supporting the outer rotary hook and the magnet plate, wherein an area of a surface of the inner bottom portion, which in a plan view overlaps with the magnet plate, has a coarse surface and one of a surface of the flange of the hook supporting shaft and a surface of the magnet plate that faces the flange is a smooth surface.

2. The horizontal rotary hook for the sewing machine according to claim 1, wherein a low friction member for reducing a friction coefficient is provided between the flange of the hook supporting shaft and the magnet plate, so that the friction coefficient between a contact surface of the magnet plate that comes into contact with the outer rotary hook and the outer rotary hook is set to be larger than the friction coefficient between the surface of the flange of the hook supporting shaft and the magnet plate.

3. The horizontal rotary hook for the sewing machine according to claim 1, wherein the flange is subjected to a surface finishing for reducing a friction coefficient between the flange of the hook supporting shaft and the magnet plate, so that a friction coefficient between a contact surface of the magnet plate that comes into contact with the outer rotary hook and the outer rotary hook is set to be larger than a friction coefficient between the surface of the flange of the hook supporting shaft and the magnet plate.

4. The horizontal rotary hook for the sewing machine according to claim 1, wherein said surface of the magnet plate is subjected to a surface finishing for reducing a friction coefficient between the flange of the hook supporting shaft and the magnet plate, so that a friction coefficient between a contact surface of the magnet plate that comes into contact with the outer rotary hook and the outer rotary hook is set to be larger than the friction coefficient between the flange of the hook supporting shaft and the magnet plate.

5. The horizontal rotary hook for the sewing machine according to claim 1, wherein the surface of the flange faces the magnet plate.

6. The horizontal rotary hook for the sewing machine according to claim 1, wherein the surface of the flange of the hook supporting shaft is the smooth surface.

7. The horizontal rotary hook for the sewing machine according to claim 1, wherein said surface of the magnet plate that faces the flange is the smooth surface.

8. The horizontal rotary hook for the sewing machine according to claim 1, wherein an uppermost surface of the magnet plate is located below a bottom surface of the permanent magnet.

9. The horizontal rotary hook for the sewing machine according to claim 1, wherein, with respect to a bottom surface of the magnet plate, a height of an upper surface of the inner bottom portion is less than a height of an upper surface of the magnet plate.

10. The horizontal rotary hook for the sewing machine according to claim 1, wherein an entirety of the surface of the inner bottom portion includes the coarse surface.

11. The horizontal rotary hook for the sewing machine according to claim 1, wherein, in the plan view, the magnetic plate extends on the inner bottom portion outside the area of the surface of the inner bottom portion that overlaps with the magnet plate.

12. A horizontal rotary hook for a sewing machine, the horizontal rotary hook comprising:

an inner rotary hook including an attracted member comprising a metal in an outer lower surface portion;

a permanent magnet that attracts the inner rotary hook;

a magnet plate accommodating the permanent magnet and provided with a mounting hole at a center of a diameter thereof;

a non-magnetic outer rotary hook accommodating the magnet plate and including a shaft hole at a center of a diameter of an inner bottom portion thereof; and a hook supporting shaft that is inserted through the mounting hole of the magnet plate and the shaft hole of the outer rotary hook and includes, at an upper end thereof, a flange for rotatably supporting the outer rotary hook and the magnet plate, wherein a contact surface of the magnet plate, which comes into contact with the outer rotary hook, is a coarse surface and a surface of the flange of the hook supporting shaft is a smooth surface.

13. A horizontal rotary hook for a sewing machine, the horizontal rotary hook comprising:

an inner rotary hook including an attracted member comprising a metal in an outer lower surface portion;

a permanent magnet that attracts the inner rotary hook;

a magnet plate accommodating the permanent magnet and provided with a mounting hole at a center of a diameter thereof;

a non-magnetic outer rotary hook accommodating the magnet and including a shaft hole at a center of a diameter of an inner bottom portion thereof; and a hook supporting shaft that is inserted through the mounting hole of the magnet plate and the shaft hole of the outer rotary hook and includes, at an upper end thereof, a flange for rotatably supporting the outer rotary hook and the magnet plate, wherein a contact surface of the magnet plate, which comes into contact with the outer rotary hook, is a coarse surface and another surface of the magnet plate that faces the flange is a smooth surface.

* * * * *